United States Patent [19]

Martin

[11] Patent Number: 4,847,458

[45] Date of Patent: Jul. 11, 1989

[54] ELECTRIC SWITCH

[75] Inventor: Adolf H. Martin, Glenview, Ill.

[73] Assignee: Adams Elevator Equipment Company, Skokie, Ill.

[21] Appl. No.: 262,850

[22] Filed: Oct. 26, 1988

[51] Int. Cl.[4] ..... H01H 23/24

[52] U.S. Cl. ..... 200/561; 200/339; 200/558

[58] Field of Search ..... 200/339, 332, 332.1, 200/553, 556, 558, 561, 573

[56] References Cited

U.S. PATENT DOCUMENTS

| | | | |
|---|---|---|---|
| 2,133,545 | 10/1938 | Krieger | 200/558 |
| 3,501,599 | 3/1970 | Horecky | 200/561 |
| 4,689,456 | 8/1987 | Martin | 200/43.08 |

*Primary Examiner*—Renee S. Luebke

*Attorney, Agent, or Firm*—D. R. Lackey

[57] ABSTRACT

An electric switch which translates a pivotable toggle motion to a rectilinear contact engaging and breaking movement, including an actuator assembly and a contact assembly which are clamped together during assembly with a face plate. The actuator assembly facilitates assembly by capturing a pivotable operating lever between a halo which adapts the actuator assembly to a face plate, and a halo adapter which adapts the actuator assembly to the contact assembly. The contact assembly includes a movable contact carrier to which a cam is fixed. The cam includes a recess which defines spaced lateral stops, and a cam surface which slopes axially inward between the spaced lateral stops, with the operating lever having a cam actuator end which enters the recess and rides on the cam surface.

5 Claims, 3 Drawing Sheets

ELECTRIC SWITCH

TECHNICAL FIELD

The invention relates in general to electric switches, and more specifically to electrical switches which translate movement of a pivotable actuator to rectilinear movement of a movable contact carrier of an electrical contact assembly.

BACKGROUND ART

The push button electrical switch described and claimed in U.S. Pat. No. 4,504,713, which is assigned to the same assignee as the present application, is of modular construction, including a contact module or assembly having a contact carrier biased for resilient reciprocation between predetermined axial limits within a housing. A cover module for the contact module includes a push button manually movable between predetermined axial limits.

In the electric switch art the need also exists for key switches, toggle switches, and the like. For manufacturing and assembly purposes it is desirable that different types of electrical switches use some of the same modules, when practical, or the same modules with slight modifications. Accordingly, my application Ser. No. 857,678, filed Apr. 30, 1986, entitled "Key Switch Having Cooperable Cams Which Translate Rotary Motion To Rectilinear", utilizes the contact module of the aforesaid patent in a key switch application. It would be desirable, and it is the object of the present invention, to provide a new and improved toggle type electrical switch which may utilize the contact module of the aforesaid patent.

DISCLOSURE OF THE INVENTION

Briefly, the present invention is an electric switch which includes a contact module or assembly, an actuator module or assembly, and means for simultaneously clamping the two modules together and to a face plate. Manufacturing and assembly of the actuator module is facilitated by a structure in which the elements of the actuator module are held in the desired relative relationship by the same clamping means which clamps the two modules together. Manufacturing and assembly of the contact module is facilitated as the same contact module used in the aforesaid patent may be used in the present invention merely by providing a recess in the movable contact carrier of the contact module for receiving a cam.

The actuator module includes a halo, an operating lever, and a halo module. The operating lever is sandwiched between the halo and halo module, and these elements are temporarily held in the desired positional relationships by frictional engagement. When the actuator module is coupled with the contact module, as modified with the cam, the clamping means which holds the two elements together and to a face plate also provides the clamping force for positively holding the elements of the actuator module in assembled relation.

BRIEF DESCRIPTION OF THE DRAWINGS

The invention will become more apparent by reading the following detailed description in conjunction with the drawings, which are shown by way of example, only, wherein.

DESCRIPTION OF THE PREFERRED EMBODIMENTS

Figure 1:
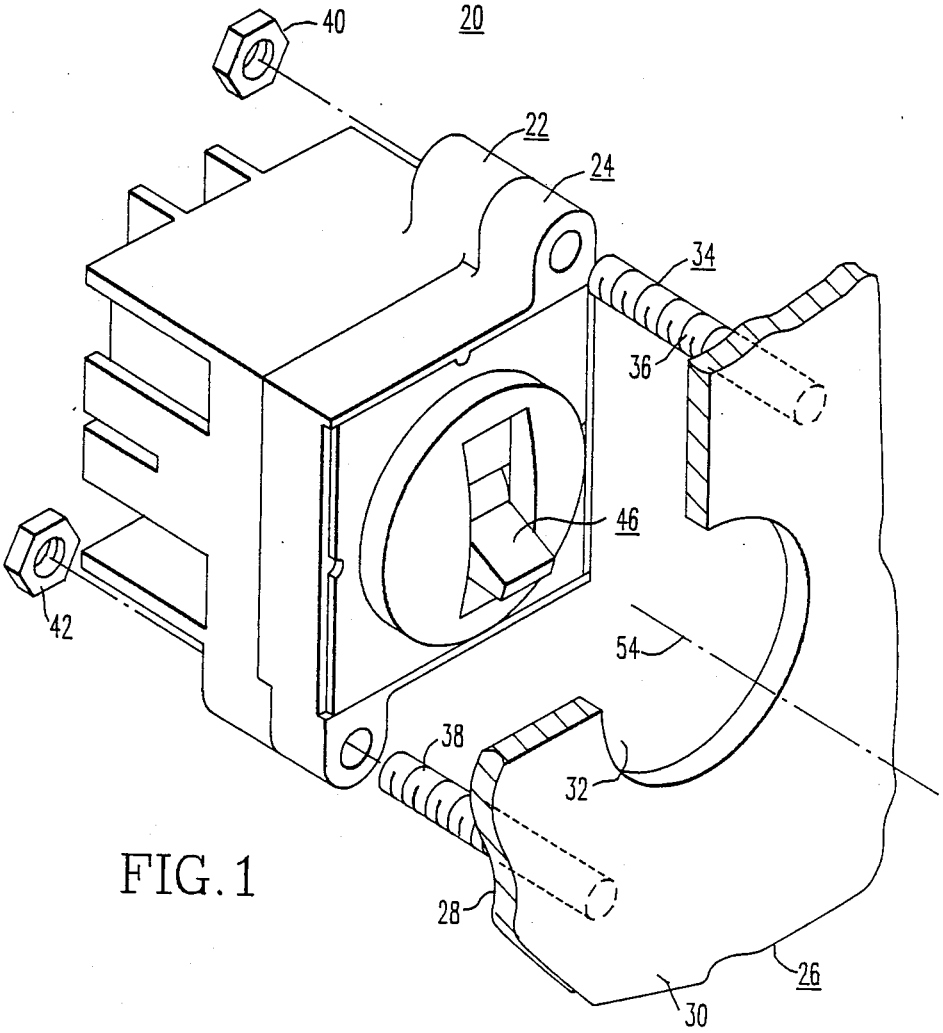
FIG. 1 is a perspective view of an electrical switch constructed according to the teachings of the invention.

Referring now to the drawings, and to FIG. 1 in particular, there is shown a perspective view of a two-position electrical toggle switch 20 constructed according to the teachings of the invention. Toggle switch 20 is of modular construction, including an electrical contact module 22 and an actuator module 24. The various elements of switch 20 to be hereinafter described may be constructed of suitable high strength plastics, or when electrical insulation is not required, by a suitable metal. For example, nylon may be used for parts subjected to operational friction, and a polycarbonate for housing and other non-operational members.

Electrical switch 20 is adapted for panel mounting in a face plate 26 having inner and outer major sides or surfaces 28 and 30, respectively, and an opening 32 which extends between sides 28 and 30. Electrical switch 20 is fixed to the inner side 28 of face plate 26 by clamping means 34 which includes first and second stud members 36 and 38 which are fixed to inner side 28, and first and second nuts 40 and 42 which threadably engage stud members 36 and 38. Clamping means 34 simultaneously clamps the contact and actuator modules together, sandwiching the actuator module 24 between the contact module 22 and the inner side 28 of face plate 26. As will be hereinafter explained, clamping means 34 also provides the clamping force which holds the elements of the actuator module 24 in the desired assembled relation, simplifying manufacture and assembly of electrical switch 20.

Figure 2:
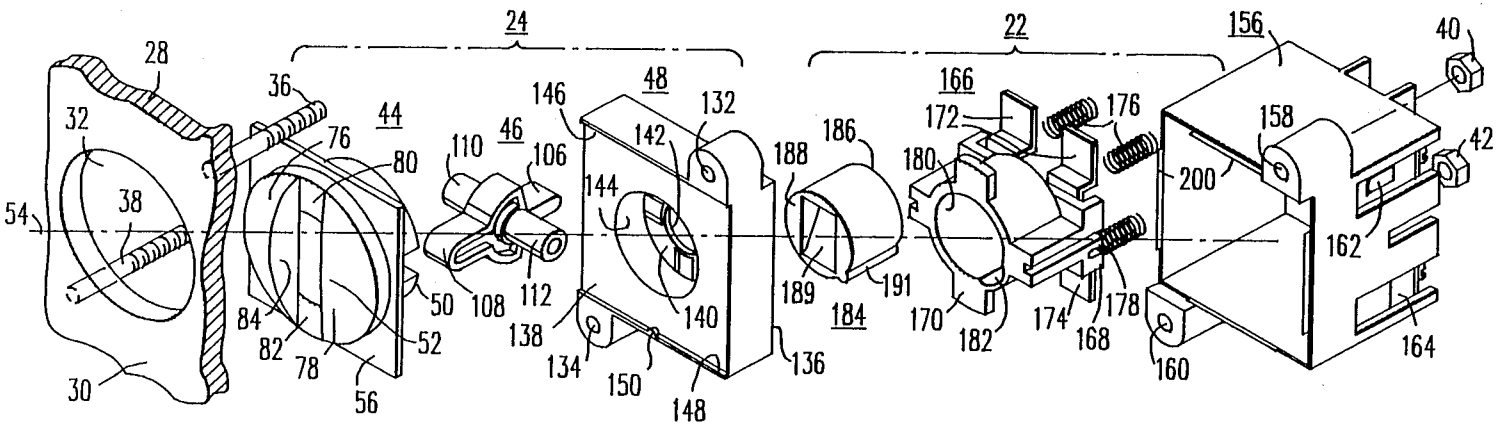
FIG. 2 is an exploded perspective view of the electrical switch shown in FIG. 1.
Figure 3:
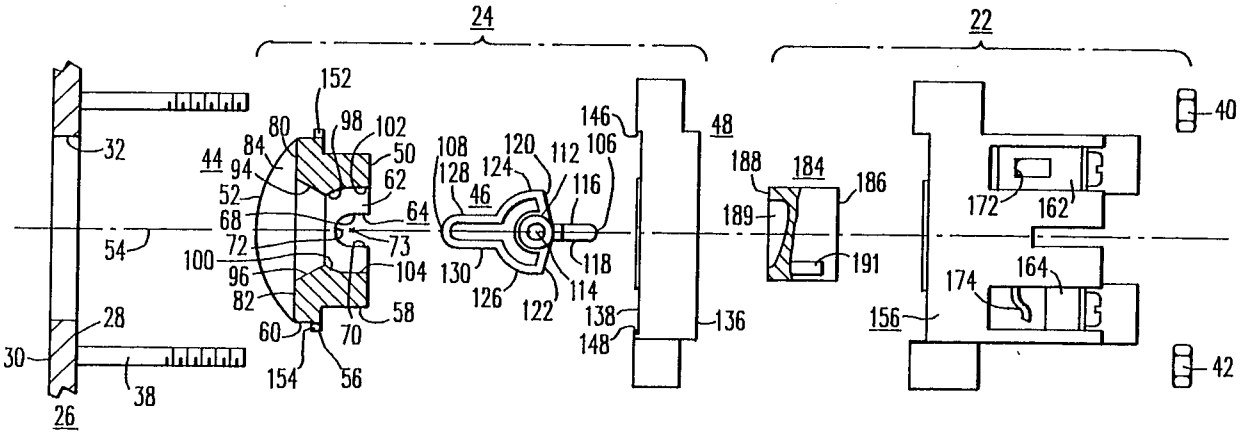
FIG. 3 is an exploded elevational view of the electrical switch shown in FIG. 1.

FIGS. 2 and 3 are exploded perspective and elevational views, respectively, of electrical switch 20, which more clearly illustrate the elements of the contact and actuator modules 22 and 24, respectively.

Actuator module 24 includes a halo 44, an operating lever 46, and a halo adapter 48. Halo 44 adapts the actuator module 24 to face plate 26, and halo adapter 48 adapts the actuator module 24 to the contact module 22. Halo 44 has first and second axial ends 50 and 52, respectively, relative to a longitudinal axis 54 disposed through switch 20 which is concentric with opening 32 in face plate 26.

Figure 4:
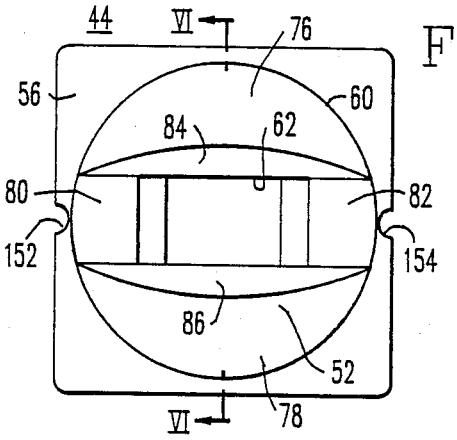
FIG. 4 is a front view of a halo element of the electrical switch shown in FIGS. 1, 2 and 3.
Figure 6:
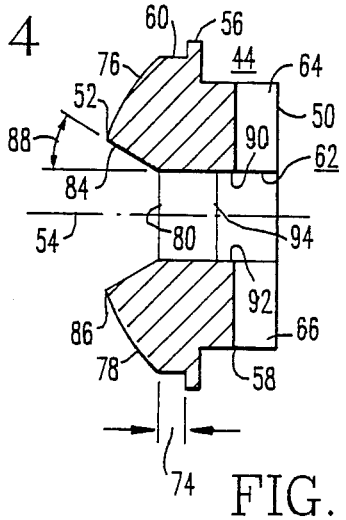
FIG. 6 is a sectional view of the halo shown in FIG. 4, taken between and in the direction of arrows VI—VI.
Figure 5:
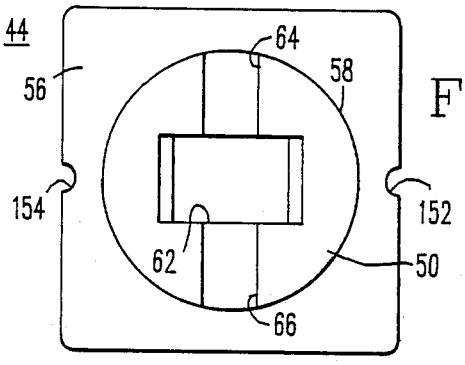
FIG. 5 is a rear view of the halo shown in FIG. 4.

FIGS. 4 and 5 are views of the second and first axial ends 52 and 50 of halo 44, and FIG. 6 is a sectional view of halo 44, taken between and in the direction arrows VI—VI in FIG. 4. Halo 44 includes a flange 56 intermediate its ends, first and second cylindrical projections 58 and 60, respectively, which extend outwardly from flange 56 towards the first and second axial ends 50 and 52, respectively, and an opening 62 which extends between axial ends 50 and 52.

Cylindrical projection 58 has first and second recesses 64 and 66, respectively, disposed in alignment on opposite sides of opening 62. Recesses 64 and 66 each have straight parallel sides terminating in a surface which defines a half-circle in cross section, such as straight sides 68 and 70 and curved end surface 72 of recess 64, best shown in FIG. 3. The curved end surface 72 has a central axis 73.

Cylindrical projection 60 extends perpendicularly outward from flange 56 for a predetermined dimension indicated at 74, which is preferably equal to the thickness dimension of face plate 26, such as 0.125 inch (3.2 mm). Projection 60 then terminates with spherical surfaces 76 and 78 which are spaced apart by opening 62 and by flat recesses 80 and 82 whose surfaces are perpendicular to longitudinal axis 54.

As shown in the sectional view of halo 44 in FIG. 6, opening 62 starts at the second axial end 52 defined by two spaced flat surfaces 84 and 86 which angle inwardly at a predetermined angle, such as an angle of 30 degrees, as indicated at 88 for surface 84. The angled surfaces terminate when reaching the flat recesses 80 and 82, and opening 62 is then defined by spaced parallel flat surfaces 90 and 92 as opening 62 proceeds to the first axial end 52. As shown in the sectional view of halo 44 in FIG. 3, opening 62 starts at flat recesses 80 and 82 and angles inwardly toward longitudinal axis 54, defined by surfaces 94 and 96, at predetermined angles such as 30 degrees. Flat surfaces 94 and 96 then terminate and radius outward, away from axis 54, for a predetermined short dimension, defined by curved surfaces 98 and 100. Curved surfaces 98 and 100 then flow smoothly into flat parallel surfaces 102 and 104, respectively, which continue to the first axial end 50 of halo 44.

Figure 7:
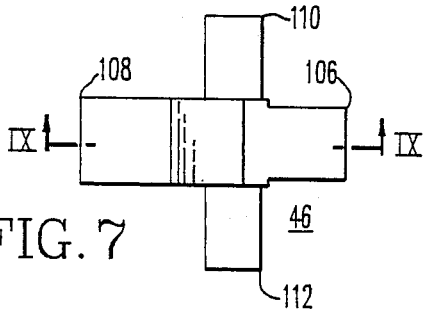
FIG. 7 is a plan view of an operating lever shown in FIGS. 1, 2 and 3.
Figure 9:
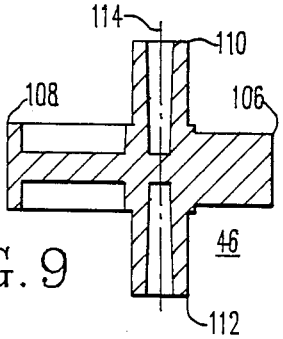
FIG. 9 is a sectional view of the operating lever shown in FIG. 7, taken between and in the direction of arrows IX—IX.
Figure 8:
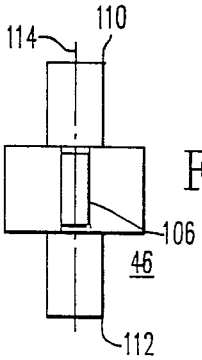
FIG. 8 is a rear end view of the operating lever shown in FIG. 7.

Operating lever 46, which is shown in a top view in FIG. 7, an end view in FIG. 8, a sectional view in FIG. 9, with the section being taken between arrows IX—IX in FIG. 7, as well as in FIGS. 1, 2, and 3, has first and second axial ends 106 and 108 respectively. The first axial end 106 functions as a cam actuator and the second axial end 108 functions as an actuating or operating handle for manually actuating switch 20. First and second pins or trunnions 110 and 112 extend outwardly from opposite sides of lever 46, on a common axis 114. Trunnions 110 and 112 have a diameter selected such that they will snugly enter recesses 64 and 66, respectively, which recesses function as bearings for supporting pivotable movement of operating lever 46 about axis 114.

Operating lever 46 starts at the first axial end 106 with a radius, such as 0.062 inch (1.6 mm) and then the radius terminates in flat parallel sides 116 and 118 which extend towards the second axial end 108 for a predetermined dimension. Sides 116 and 118 then meet flat surfaces 120 and 122, respectively, which angle outwardly at predetermined angles, such as 105 degrees. Flat surfaces 120 and 122 then meet curved surfaces 124 and 126 which have a predetermined radius, such as 0.312 inch (7.9 mm), with curved surfaces 124 and 126 being closely adjacent to curved surfaces 98 and 100 of halo 44 when lever 46 is assembled with halo 44. Curved surfaces 124 and 126 meet flat parallel surfaces 128 and 130, respectively, which continue to the second axial end 108, which terminates in a radius such as 0.125 inch (3.2 mm).

Halo adapter 48 includes stud receiving openings 132 and 134 spaced and dimensioned to receive studs 36 and 38, respectively. Halo adapter 48 has first and second axial ends 136 and 138, respectively, and a wall 140 disposed adjacent to the first axial end 136. Wall 140 has a surface 142 which defines a circular opening coaxial with longitudinal axis 54. Halo adapter 48 also includes a surface 144 which defines a circular opening which starts at the second axial end 138 and extends to wall 140. The opening defined by surface 142 is sized to enable the cam actuating end 106 of operating lever 46 to extend therethrough, and to move through a predetermined pivotable range. The opening defined by surface 144 is sized to snugly but slidably receive cylindrical projection 58 of halo 44.

The second axial end 138 of halo adapter 48 is recessed slightly for a dimension equal to the thickness dimension of flange 56 of halo 44, providing upper and lower lips or extensions 146 and 148, respectively. Lips 146 and 148 are spaced to snugly receive flange 56, which, along with a projection 150 on lip 148 which enters a notch 152, or a notch 154, in flange 56, properly align halo 44 about axis 54.

Except for a modification to be hereinafter described, the contact module 22 may be the electrical contact assembly shown in detail in the hereinbefore mentioned U.S. Pat. No. 4,504,713, which is hereby incorporated into the specification of the present application by reference. Contact module 22 includes a housing 156 having stud receiving openings 158 and 160 for receiving studs 36 and 38 of face plate 26, and stationary electrical contacts 162 and 164. The stationary electrical contacts may be normally open, normally closed, or mixed. For purposes of example, stationary contact 162 is illustrated as being of the normally closed type and stationary contact 164 is illustrated as being of the normally open type.

Contact module 22 further includes a contact carrier 166 having first and second axial ends 168 and 170, with the first axial end carrying electrical contacts 172 and 174 for cooperating with the stationary contacts 162 and 164, respectively. Contact carrier 166 is mounted for guided rectilinear motion within housing 156, along axis 54, via cooperative ribs and grooves. Bias means in the form of a plurality of compression springs 176 disposed between housing 156 and the first axial end 168 of the contact carrier 166, bias contact carrier 166 towards a first axial limit established by a leg portion 178 of the contact carrier contacting a housing surface, as fully shown in the incorporated patent. A second axial limit, which is reached by overcoming the bias of springs 176, is provided when the contact carrier 166 contacts a wall portion of housing 156, also as fully described in the incorporated patent.

The second axial end 170 of contact carrier 166 is modified according to the teachings of the invention by providing a cylindrical recess 180 which extends inwardly from end 170 for a predetermined dimension. An axially extending locating groove 182 is formed in the wall which defines recess 180.

Figure 10:
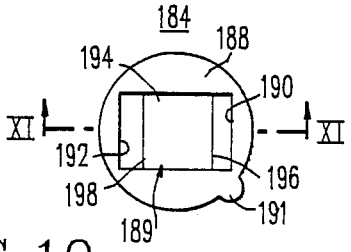
FIG. 10 is a front end view of a cam shown in FIGS. 2 and 3.
Figure 11:
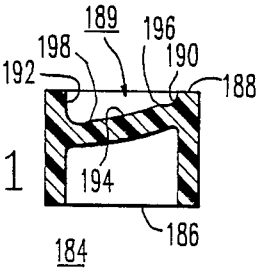
FIG. 11 is a sectional view of the cam shown in FIG. 10, taken between and in the direction of arrows XI—XI.

A cam 184, best shown in FIGS. 2, 10 and 11, is disposed in recess 180. Cam 184, a well as operating lever 46, are preferably molded from a nylon, because nylon is well suited for components subjected to an operational friction. Cam 184, which is substantially cylindrical, includes first and second axial ends 186 and 188, respectively, with the second axial end 188 having a recess 189. The diameter of cam 184 is selected to enter recess 180 of contact carrier 166 with a press fit, with the outer surface of cam 184 having a rib 191 which enters groove 182 to properly orient cam 184. Recess 189 is formed by first and second inward steps 190 and 192, respectively, which extend inwardly from the second axial end 188 to define or function as first and second lateral limits. A cam surface 194 slopes inwardly from the first inward step 190 to the second inward step 192, as shown most clearly in FIGS. 10 and 11, with FIG. 10 being a view of the second axial end 188 of cam 184, and with FIG. 11 being a sectional view of cam 184 taken between and in the direction of arrows XI—XI in FIG. 10. First and second grooves 196 and 198 are disposed adjacent to lateral limits 190 and 192, respectively, for providing positive locating positions for the cam actuating end 106 of operating lever 46, to provide tactile feedback which indicates when the operating lever 46 has been moved from one operating position to another. The depth of recess 189 is selected such that when cam actuator end 106 is seated in groove 198 adjacent to lateral stop or step 192, springs 176 will have only a slight compression, providing enough spring pressure to maintain end 106 in groove 198, while still providing complete closure of normally closed contacts, and the desired clearance between normally open contacts. Movement of operating lever 46 such that the cam actuating end 106 is moved across cam surface 194 to groove 196 adjacent to lateral stop 190, forces contact carrier 166 inwardly against the bias of springs 176, to a position which fully opens normally closed contacts and fully closes normally open contacts. The bias provided by springs 176 again hold end 106 of operating lever 46 in groove 196, maintaining the manually selected position of switch 20.

Manufacture and assembly of switch 20 is facilitated by the disclosed construction, as advantage is taken of the clamping arrangement in which switch 20 is mounted on a face plate 26 of a panel to hold the actuating elements of the actuator module 24 in the desired assembled relation. With the disclosed arrangement, the elements of actuator module 24 are frictionally assembled, with the halo 44 and halo adapter 48 cooperatively providing bearing support for trunnions 110 and 112, which support is perfected when actuator module 24 is firmly clamped between face plate 26 and contact module 22 by clamping means 34.

More specifically, in assembling switch 20, the handle end 108 of operating lever 46 is inserted into opening 62 defined by halo 44, until trunnions 110 and 112 are disposed in recesses 64 and 66 of halo 44. The spherical surfaces 76 and 78 protect handle 108 from accidental actuation, and the angled surfaces 84 and 86, as well as the recessed flat surfaces 80 and 82, provide adequate room for finger actuation of handle 108. The flat surfaces 94 and 96 provide positive stops for handle 108, as sides 128 and 130 contact surfaces 94 and 96 to limit the pivotable movement range. Halo 44, after operating lever 46 is assembled therewith, is nested with halo adapter 48 by advancing cylindrical projection 58 into the opening of halo adapter 48 defined by surface 144. The dimensions of the mating parts are such that the elements of actuator module 24 will remain in assembled relation by frictional engagement, with the back wall 140 of halo adapter 48 being disposed against trunnions 110 and 112 of operating lever 46. Actuator module 24 is then assembled with contact module 22, with housing 156 having forward projections 200 which snugly enter an opening in the first axial end 136 of the halo adapter, as fully described in the incorporated patent, to frictionally hold the actuator and contact modules in assembled relation. At this point the bias of springs 176 will force halo 44, along with operating lever 46, slightly forward, but the elements of the actuator module will remain coupled, even when the halo module is not forcibly seated or nested with halo adapter. A forcible seating which results in a bias being placed on the operating lever regardless of its operative position, will occur during final assembly with face plate 26. This final assembly is made by advancing stud 36 into aligned openings 132 and 158 of halo adapter 48 and housing 156, and stud 38 into aligned openings 134 and 160, with cylindrical projection 60 of halo 44 entering opening 32 in face plate 26. Engaging nuts 40 and 42 with studs 36 and 38 and tightening them, clamp actuator module 24 tightly between inner surface 28 of face plate 26 and contact module 22, forcing flange 56 of halo 44 tightly against halo adapter 48 to complete or perfect the bearing support for trunnions 110 and 112 by cooperative surfaces of halo 44 and halo adapter 48. The clamping means 34 also holds switch 20 to face plate 26.

I claim:

1. An electric switch, comprising:

a contact assembly including a housing having first and second axial ends, and a contact carrier mounted in said housing for rectilinear movement between first and second axial limits, with at least one of said limits being a contact engaging position, and biasing means urging said contact carrier towards said second axial limit, a cam carried by said contact carrier, said cam defining first and second spaced lateral limits, and a recessed cam surface, accessible via the second axial end of said housing, which extends between said spaced lateral limits, a face plate having inner and outer surfaces, and an opening which extends between said inner and outer surfaces, a halo having first and second axial ends, an operating lever pivotally carried by said halo, said operating lever having cam actuator and handle ends which respectively extend outwardly from the first and second ends of said halo, as a handle, and a halo adapter having first and second ends, and an opening disposed between said first and second ends said halo being nested within the opening of said halo adapter, completing positional support for said operating lever by sandwiching said operating lever between said halo and halo adapter to form an actuator assembly, and means clamping said actuator assembly between the inner surface of said face plate and the second axial end of said housing, with the cam actuator end of said operating lever in contact with the recessed cam surface, such that pivotable movement of the handle end of the operating lever simultaneously moves the cam actuator end of the operating lever between the first and second lateral limits of the cam, and the contact carrier between the first and second axial limits, against the urging of said biasing means.

2. The electric switch of claim 1 wherein the recessed cam surface defines first and second grooves adjacent to the first and second lateral stops, respectively, which positively position the cam actuator end of the operating lever to define first and second operating positions.

3. The electric switch of claim 1 wherein the contact carrier has first and second axial ends, with the second axial end defining a recess, and the cam is a cylindrical button having first and second axial ends, with the recessed surface of the cam extending inwardly from the second axial end, and wherein the cam is disposed in the recess at the second axial end of the contact carrier with the second axial end of the cam being disposed in substantially the same plane as the second axial end of the contact carrier.

4. The electric switch of claim 3 wherein the cam includes first and second inward steps from the second axial end, which respectively define the first and second spaced lateral limits, and wherein the recessed cam surface extends between said first and second inward steps.

5. The electric switch of claim 1 wherein the operating lever includes first and second coaxial trunnions, the halo includes first and second spaced, aligned recesses which extend inwardly from the first axial end for respectively receiving said first and second trunnions, and the halo adapter includes a wall portion which maintains the first and second trunnions in the first and second recesses.

* * * * *